US005465465A

United States Patent [19]

Stahlecker

[11] Patent Number: 5,465,465

[45] Date of Patent: Nov. 14, 1995

[54] TWO-APRON DRAFTING UNIT COMPRISING AT LEAST ONE SLIVER GUIDE

[75] Inventor: Fritz Stahlecker, Bad Überkingen, Germany

[73] Assignee: Hans Stahlecker, Germany

[21] Appl. No.: 76,783

[22] Filed: Jun. 15, 1993

[30] Foreign Application Priority Data

Jun. 27, 1992 [DE] Germany ..... 42 21 157.3

[51] Int. Cl.[6] ..... D01H 5/72

[52] U.S. Cl. ..... 19/292; 19/244

[58] Field of Search ..... 19/244, 248, 249, 19/252, 253, 254, 255, 256, 288, 287, 291, 292

[56] References Cited

U.S. PATENT DOCUMENTS

| | | | |
|---|---|---|---|
| 1,992,121 | 2/1935 | Casablancas | 19/291 |
| 2,683,290 | 7/1954 | Noguera | 19/287 |
| 2,735,141 | 2/1956 | Tarbox | 19/288 |
| 2,931,073 | 4/1960 | Graf | 19/253 |
| 3,251,098 | 5/1966 | Warthen | 19/291 |
| 4,051,577 | 10/1977 | Swanson . | |

FOREIGN PATENT DOCUMENTS

| | | |
|---|---|---|
| 1914021 | 2/1965 | Germany . |

*Primary Examiner*—Clifford D. Crowder
*Assistant Examiner*—Michael A. Neas
*Attorney, Agent, or Firm*—Evenson, McKeown, Edwards & Lenahan

[57] ABSTRACT

A two-apron drafting unit comprises at least one sliver guide which projects into the wedge-shaped gap of the roller pair which follows the apron unit. The sliver guide has a defined distance from the surfaces of the roller pair and can be moved within certain limits in the longitudinal direction of the roller pair. The sliver guide is arranged in a holding device which is aligned in parallel to the roller pair as well as with respect to the height of the drafting zone plane. The holding device, which has a slideway for the sliver guide, is arranged on a supporting part which is connected with the lower deflection guide for the bottom apron.

8 Claims, 3 Drawing Sheets

TWO-APRON DRAFTING UNIT COMPRISING AT LEAST ONE SLIVER GUIDE

BACKGROUND AND SUMMARY OF THE INVENTION

The present invention relates to a two-apron drafting unit comprising at least one sliver guide which projects into the wedge-shaped gap of the roller pair which follows the upper and lower deflection guides of the aprons, has a defined distance to the surfaces of the roller pair, can be moved within certain limits in the longitudinal direction of the roller pair, and is arranged on a holding device which is aligned in parallel to the roller pair as well as with respect to the height of the drafting zone plane.

A two-apron drafting unit of this type is prior art on the basis of U.S. Pat. No. 4,051,577. The sliver guide is arranged by means of a rectangular recess with a clearance on all sides on a leaf-spring-type holding device which, on the one side, is fastened to a rail extending in parallel to the drafting unit rollers against which the cradle is supported which forms the lower deflection guide. The alignment of the sliver guide with respect to the lower deflection guide is therefore only indirect and is relatively rough because of the existing clearance with respect to the holding device. Because of the rough play, the mobility in the longitudinal direction of the roller pair also permits a certain jamming of the sliver guide so that, although the parallelism with respect to the roller pair exists to a certain degree, it is still insufficient.

On the basis of the German Utility Model 19 14 021, it is known to arrange the sliver guides on sliding sections of a rod so that the sliver guides can follow the traversing movement of the fiber material. It is left open where the rod is arranged with respect to the lower deflection guide of the bottom aprons.

In the case of high-draft drawing frames, particularly during the direct spinning of drawing frame slivers on ring spinning machines, the sliver guides must be precisely positioned.

It is therefore an object of the invention to avoid tolerance chains between the deflection guides of the apron and the sliver guide and nevertheless permit a traversing movement of the sliver guides.

This object is achieved in that the holding device, which comprises a slideway for the sliver guide, is arranged on a supporting part connected with the lower deflection guide.

As a result of the fact that the holding device has a slideway for the sliver guide, traversing movements are possible without a loss of the parallelism between the sliver guide and the roller pair and thus of the defined distance between the sliver guide and the roller pair. As a result of the fact that, in addition, the holding device is arranged on a support part connected with the lower deflection guide, the sliver guide is aligned directly on that component to which it belongs so that tolerance chains are avoided.

In a further development of the invention, the supporting part is provided with stop faces for the alignment of the upper deflection guide. As a result, the upper deflection guide can also be aligned in parallel to the roller pair and to the lower deflection guide so that a still higher precision is ensured with respect to the guiding of the fiber.

Advantageously, the holding device is a profiled wire on which the sliver guide is arranged in a non-rotatable manner. Although traversing sliding movements are permitted in this manner, tilting movements of the sliver guide are avoided in every direction.

Expediently, in certain preferred embodiments, the profiled wire is inserted into a correspondingly shaped recess of the supporting part. As a result, not only a simple holding of the profiled wire is obtained but it is aligned from the start with respect to the lower deflection guide itself.

Other objects, advantages and novel features of the present invention will become apparent from the following detailed description of the invention when considered in conjunction with the accompanying drawings.

DETAILED DESCRIPTION OF THE DRAWINGS

Figure 1:
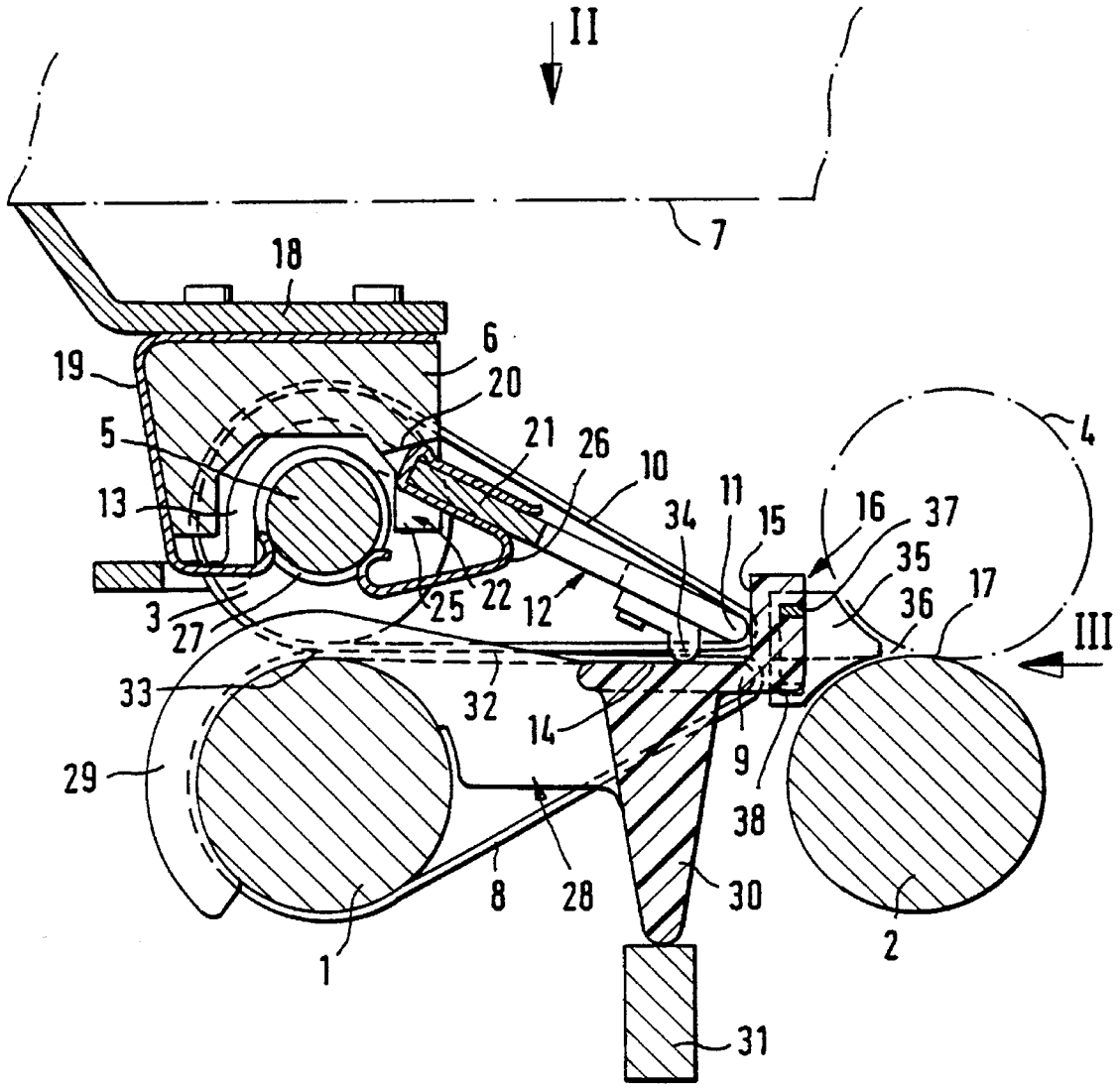
FIG.1 is a schematic sectional lateral view of a two-apron drafting unit according to the invention, in which case the plane of section is placed through the perpendicular central plane of a so-called pressure roller twin.
Figure 2:
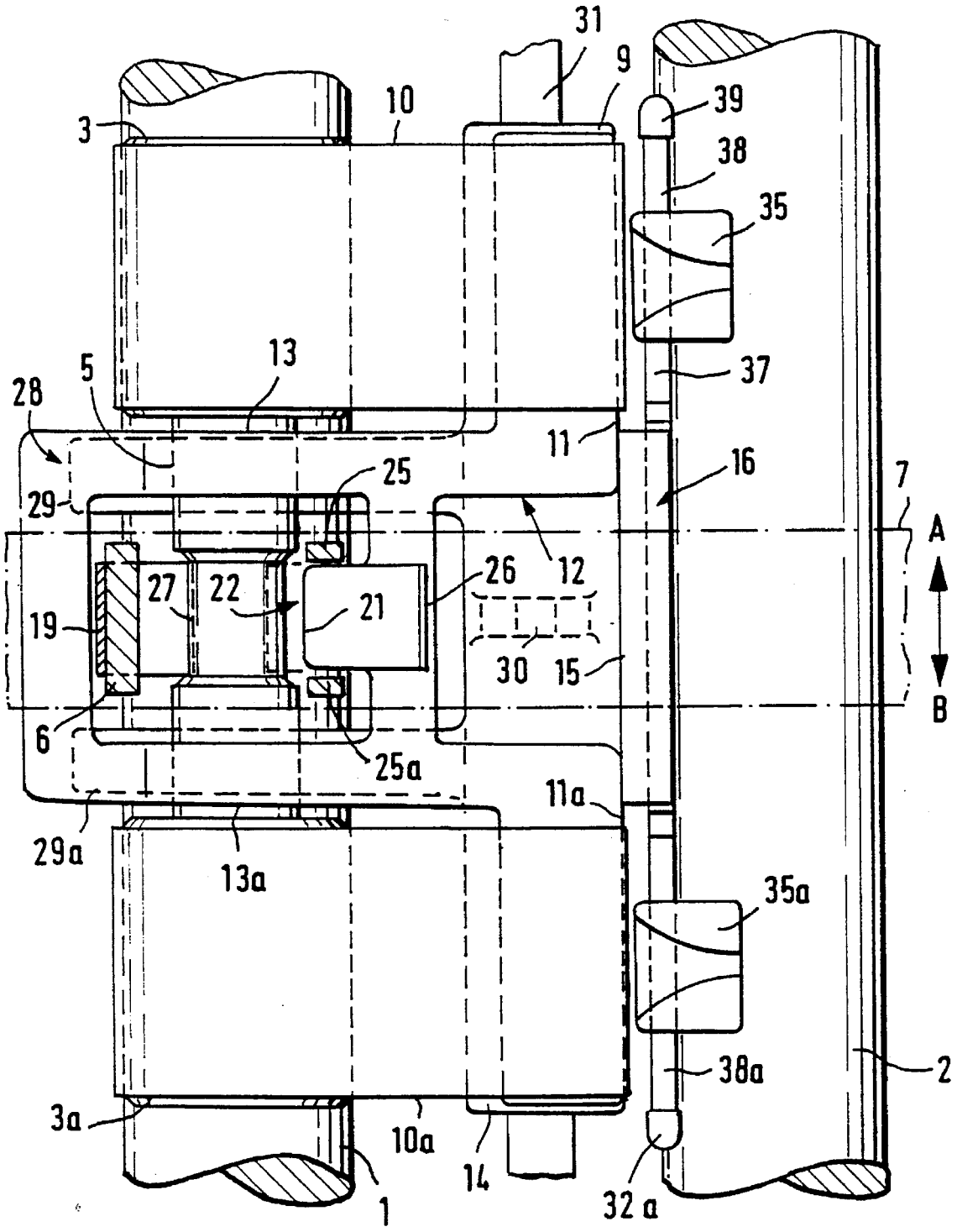
FIG. 2 is a view in the direction of the arrow II of FIG. 1, in which case a pressure roller holder holding the pressure roller twin is illustrated as a sectional view.
Figure 3:
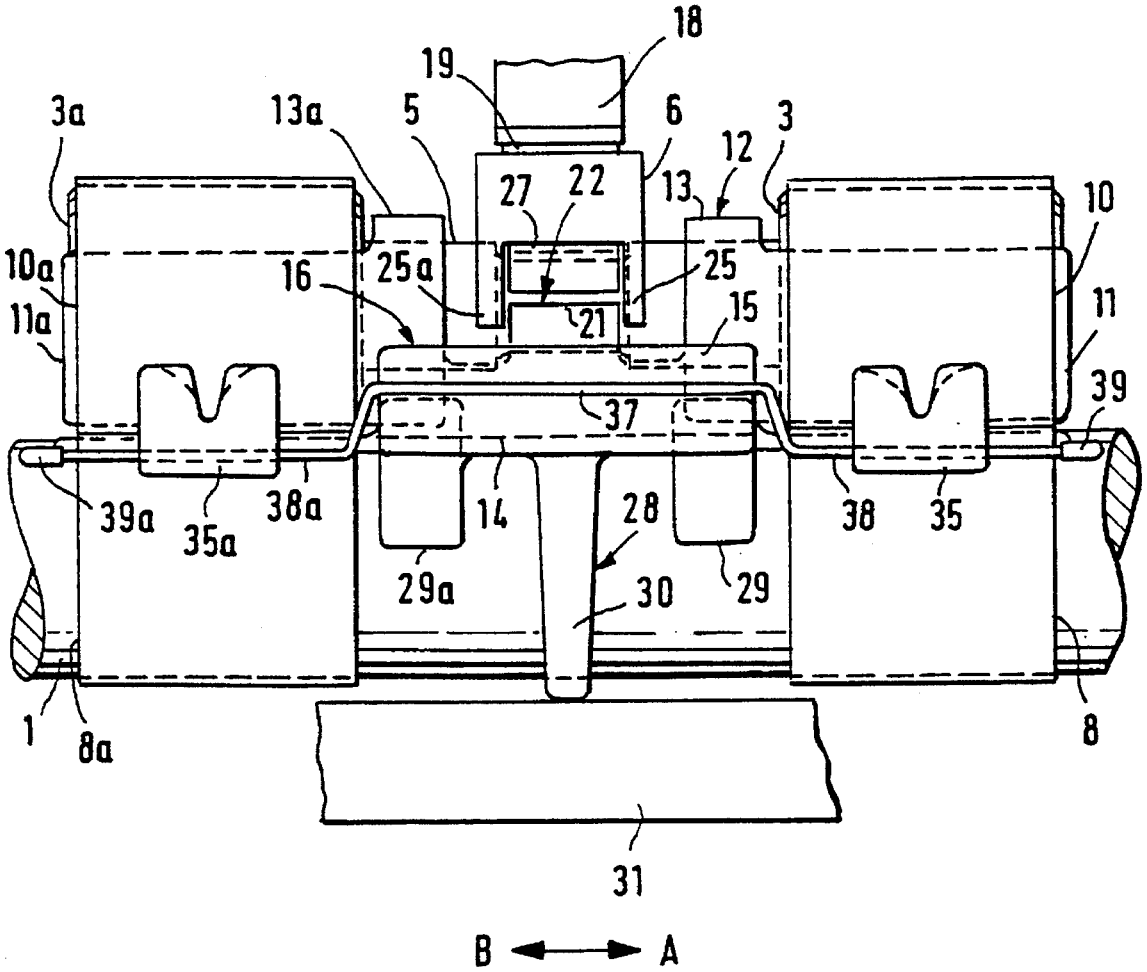
FIG. 3 is a view in the direction of the arrow III of FIG. 1, in which case a roller pair following the sliver guide was omitted.

FIGS. 1, 2, and 3 illustrate the two-apron drafting unit according to the invention only in the manner of schematic cutout views. Two drivable bottom cylinders 1 and 2 are shown which extend in the longitudinal direction of the machine and to which spring-loaded pressure rollers 3 and 4 are assigned. In addition to the two illustrated roller pairs 1, 3 and 2, 4, the two-apron drafting unit has at least one additional roller pair.

The pressure rollers 3 and 4 are connected with pressure rollers of adjacent spinning stations to form so-called pressure roller twins, as illustrated in FIGS. 2 and 3 by means of the adjacent pressure rollers 3 and 3*a* which are connected with one another by means of a common shaft 5. This basic arrangement is known to the person skilled in the art and therefore does not have to be described in detail.

The individual pressure roller twins are each held in a pressure roller holder 6 which is supported on a load carrier 7 which is only outlined and can be swivelled away from the bottom cylinders 1 and 2. The arrangement of the pressure roller holder 6 in a load carrier 7 is also known to the person skilled in the art, as indicated, for example, in the German Published Patent Application DE 38 23 872 A1. The load carriers 7 and the pressure roller holders 6 held in them are arranged in the center with respect to the pressure roller twins.

A bottom apron 8 winds around the bottom cylinder 1 which, in the case of a conventional three-cylinder drafting unit, is the center cylinder of three bottom cylinders. In the area of the bottom cylinder 2 which follows—the so-called delivery cylinder—, the bottom apron 8 is in this case guided around a lower deflection guide 9 which extends along the two spinning units assigned to the pressure roller twin. The bottom apron pertaining to the second spinning station has the reference number 8*a*.

In a corresponding manner, one top apron 10 and 10*a* respectively winds around the pressure rollers 3 and 3*a*. In the area of the roller pair 2, 4, the top aprons 10, 10*a* are guided around an upper deflection guide 11 and 11*a*. The upper deflection guides 11 and 11*a* of the two spinning stations assigned to the pressure roller twin are components of a so-called apron cradle 12.

The apron cradle 12, which extends along two spinning stations and which is therefore constructed as a so-called twin cradle, is disposed by means of half-shell-shaped guides 13 and 13*a* in the direct proximity of the pressure rollers 3 and 3*a* on the shaft 5 of the pressure roller twin and therefore at the same time guides the pressure roller twin. After a possible interruption of the operation during which the pressure rollers 3 and 3*a* are lifted off the pertaining bottom cylinder 1, the pressure rollers 3 and 3*a*, together with the apron cradle 12, must be returned into the operating position. In this case, the pressure rollers 3 and 3*a*, together with the apron cradle 12, must be aligned precisely with respect to the lower deflection guide 9 and therefore in parallel with respect to the bottom cylinders 1 and 2.

When the two-apron drafting unit is closed, thus when the load carrier 7 is lowered, the upper deflection guides 11 and 11*a* of the apron cradle 12 slide on a stop face 14 toward the roller pair 2, 4, specifically to another stop face 15. The two stop faces 14 and 15 are disposed perpendicularly with respect to one another in an L-shape and are preferably components of a common supporting part 16.

The stop face 14 defines the distance by which the upper deflection guides 11 and 11*a* are away from the lower deflection guide 9, thus the so-called mouth opening. In contrast, the stop face 15 is used essentially for the parallel alignment of the apron cradle 12 and thus of the pertaining pressure roller twin and, in addition, defines the distance of the upper deflection guides 11 and 11*a* from the nip line 17 of the roller pair 2, 4 which follows.

For the avoidance of redundancies, the shaft 5 of the pressure roller twin is radially movable in the pressure roller holder 6. The pressure roller holder 6 therefore essentially only has the function of providing the load by means of a loading spring 18. The parallel alignment of the pressure roller twin is therefore not taken over by the pressure roller holder 6. As indicated, the pressure roller holder 6 envelops the shaft 5 at a clear distance.

So that, during the opening of the two-apron drafting unit, the shaft 5 is raised along with the pressure roller holder 6, a securing spring 19 is arranged on the latter which holds the shaft 5 in the pressure roller holder 6 when the load carrier 7 is opened up.

As a result of the fact that the shaft 5 of the pressure roller twin is movable in the pressure roller holder 6 in the radial direction, the apron cradle 12 can be pressed without play against the stop faces 14 and 15 without the requirement of also moving the pressure roller holder 6. This takes place because of the fact that the load force of the loading spring 18 arranged on the pressure roller holder 6 presses against the apron cradle 12 by means of an oblique surface 20, whereby this apron cradle 12 is moved against the stop faces 14 and 15. Since the apron cradle 12, in turn, by means of its half-shell-shaped guides 13, 13*a*, rests on the shaft 5, the shaft 5 of the pressure roller twin is loaded against the pertaining bottom cylinder 1.

As mentioned above, the apron cage 12 is constructed to be two-armed because of its half-shell-shaped guides 13 and 13*a*, with a center nose 21 which is situated in-between. This nose 21 of the apron cradle 12 projects into a frontal recess 22 of the pressure roller holder 6. On the left and on the right next to the nose 21, the pressure roller holder 6 has lateral guide surfaces 25 and 25*a* which limit the mobility of the apron cradle 12 in the lateral direction.

The loading oblique surface 20 presses on a hump of a spring 26 reaching around the nose 21, which spring 26, in turn, engages in a groove 27 of the shaft 5 of the pressure roller twin. Thus, the pressure roller twin is secured also in the lateral direction because the pressure roller holder 6 guides the apron cradle 12 laterally and because the apron cage 12, in turn, guides the shaft 5 also laterally by way of the spring 26. In addition, the spring 26 has the task of holding the apron cradle 12 together with the pressure roller twin in the demounted condition.

A bottom apron cradle 28 is assigned to the bottom aprons 8 and 8*a* and is rotatably placed on the bottom cylinder 1 by means of half-shell-shaped lateral arms 29 and 29*a*. The lateral arms 29 and 29*a* are connected with one another by the table-shaped lower deflection guide 9. As a result of the fact that the bottom apron cradle 28 is placed on the pertaining bottom cylinder 1, the parallel position is very precise. The bottom apron cradle 28 has a center lengthening 10 which is supported under the effect of the loading spring 18 against a stop 31 which is preferably adjustable and is constructed as a profiled rail. This stop 31 therefore aligns the bottom apron cradle 28 with respect to the so-called drafting zone cradle 32 which is defined by the straight connecting line of the nip lines 33 and 17 of the roller pairs 1, 3 as well as 2, 4.

Since the apron cradle 12 is supported by way of an exchangeable supporting member 34 with respect to the lower deflection guide 9, the apron cradle 12 and thus the pressure roller twin is also aligned with respect to the drafting zone plane 32. Furthermore, the stop faces 14 and 15 provide a parallel alignment of the apron cradle 12.

It was found that, in the case of high-draft drawing frames, sliver guides 35 and 35*a* which act as front condensers are very advantageous. This is particularly true when drawing frame slivers—while a flyer is omitted—are fed directly to a ring spinning machine which requires drafts in the drafting units in the order of 200 times.

With respect to spinning technology, it is advantageous for the sliver guides 35 and 35*a* to have no contact or only a very slight contact with the roller pair 2, 4, but at any rate have a defined distance from the roller pair 2, 4. By no means should the sliver guides 35 and 35 be pulled completely into the wedge-shaped gap 36 of the roller pair 2, 4. Because of the advantageous traversing motion of the slivers to be drafted, however, the sliver guides 35 and 35*a* must be movable within certain limits in the lateral direction corresponding to arrows A and B.

For this purpose, the sliver guides 35 and 35*a* are threaded or clipped onto a profiled wire 37, specifically in such a manner that the profiled wire 37 contains a slideway 38 and 38*a* for each sliver guide 35, 35*a*. This will be necessary when a drafting unit is involved which has a traversing device for protecting the top aprons 10, 10*a* and the bottom aprons 8, 8*a*.

The supporting part 16, which comprises the stop faces 14 and 15 for the apron cradle 12, has a slot with a preferably rectangular cross-section into which the correspondingly shaped profiled wire 37 is clipped. On both sides of its holding device in the supporting part 16, the profiled wire 37 is bent downward at a right angle so that the sliver guides 35 and 35*a* which can be moved on the slideways 38 and 38*a* have the correct height with respect to the drafting zone plane 32.

On its ends, the profiled wire 37 has plastic thickenings 39 and 39*a* so that the sliver guides 35 and 35*a* cannot fall out. The thickenings 39, 39*a* are dimensioned such that, when a low force is applied, the sliver guides 35 and 35*a* can just barely still be threaded but that they are sufficiently secured during the operation of the drafting unit.

The positioning of the profiled wire 37 with respect to the roller pair 2, 4 is important, and particularly with respect to the deflection guides 9 and 11, 11*a*. On the one hand, it is to be prevented that the sliver guides 35 and 35*a* come to rest against the surfaces of the rollers 2 and 4, and furthermore, it is to be ensured that the profiled wire 37 extends in parallel with respect to the nip line 17 and the lower deflection guide 9. In their bore, the sliver guides 35, 35*a* are therefore adapted to the profiled wire 37 and are thus secured with respect to an unacceptable rotation. A rectangular cross-section was found to be advantageous.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A two-apron drafting unit comprising:

an upper apron supported on an upper apron deflection guide, a lower apron supported on a lower apron deflection guide, a holding device arranged on a supporting part connected with the lower apron deflection guide, said supporting part including two stop faces extending substantially perpendicular to one another and engageable with the upper apron deflection guide for aligning the upper deflection guide with respect to the lower deflection guide, and a sliver guide which projects into a wedge-shaped gap of a roller pair disposed downstream of the upper and lower apron deflection guides, said sliver guide being arranged on a slideway fixed at the holding device, which slideway extends in alignment parallel to the axis of the roller pair and in a level of a drafting zone plane, said slideway and sliver guide being configured to assure and permit non-rotational movement of the sliver guide in a direction parallel to the roller pair.

2. A two-apron drafting unit according to claim 1, wherein the slideway is on a profiled wire which forms said slideway on which the sliver guide is arranged in a non-rotatable manner.

3. A two-apron drafting unit according to claim 2, wherein the profiled wire is inserted into a correspondingly shaped recess which forms the holding device on the supporting part.

4. A two-apron drafting unit according to claim 3, wherein the recess in the supporting part is located above the drafting zone plane, said profiled wire being bent so as to locate the slideway so the sliver guide is disposed at the level of the drafting zone plane.

5. A two-apron drafting unit according to claim 4, wherein said drafting unit is constructed as a double drafting unit with respective pairs of upper and lower apron deflection guides spaced from one another in a direction parallel to the roller pair, and wherein a pair of sliver guides are provided, one each for the respective pairs of deflection guides.

6. A two-apron drafting unit according to claim 5, wherein the slideway is on a profiled wire which forms slideways on which both sliver guides are arranged in a non-rotatable manner.

7. A two-apron drafting unit according to claim 6, wherein the profiled wire is inserted into a correspondingly shaped recess which the holding device on the supporting part.

8. A two-apron drafting unit according to claim 7, wherein the recess in the supporting part is located above the drafting zone plane, said profiled wire being bent so as to locate the slideway so sliver guides are disposed at the level of the drafting zone plane.

* * * * *